US005928392A

United States Patent [19]

Aradi

[11] Patent Number: 5,928,392

[45] Date of Patent: Jul. 27, 1999

[54] ENHANCED COMBUSTION OF HYDROCARBONACEOUS BURNER FUELS

[75] Inventor: Allen A. Aradi, Richmond, Va.

[73] Assignee: Ethyl Corporation, Richmond, Va.

[21] Appl. No.: 08/927,594

[22] Filed: Sep. 11, 1997

Related U.S. Application Data

[63] Continuation of application No. 08/645,854, May 14, 1996, abandoned.

[51] Int. Cl.[6] ..... C10L 1/14; C10L 1/18

[52] U.S. Cl. ..... 44/359; 44/347; 431/2

[58] Field of Search ..... 44/347, 359, 381, 44/404; 431/2

[56] References Cited

U.S. PATENT DOCUMENTS

| | | | |
|---|---|---|---|
| 2,818,417 | 12/1957 | Brown et al. | 44/359 |
| 3,112,789 | 12/1963 | Percy et al. | 158/117.5 |
| 3,791,796 | 2/1974 | Gamble et al. | 431/5 |
| 3,808,802 | 5/1974 | Tanasawa | 60/39.65 |
| 4,207,078 | 6/1980 | Sweeney et al. | 44/359 |
| 4,505,718 | 3/1985 | Dorer, Jr. | 44/66 |
| 5,209,187 | 5/1993 | Khinkis | 431/9 |
| 5,236,327 | 8/1993 | Flanagan et al. | 431/12 |
| 5,370,526 | 12/1994 | Buschulte et al. | 431/116 |
| 5,460,513 | 10/1995 | Flanagan et al. | 431/9 |
| 5,462,430 | 10/1995 | Khinkis | 431/9 |
| 5,525,127 | 6/1996 | Jeffrey | 44/359 |
| 5,551,957 | 9/1996 | Cunningham et al. | 44/347 |

FOREIGN PATENT DOCUMENTS

| | | |
|---|---|---|
| 1188891 | 6/1985 | Canada . |
| 0078139 | 10/1987 | European Pat. Off. . |
| 0476197 | 3/1992 | European Pat. Off. . |
| 1413323 | 11/1975 | United Kingdom . |

OTHER PUBLICATIONS

Keszthelyi et al., *Period. Polytech., Chem. Eng.*, vol. 21(1), pp. 79–93 (1977) month unknown.

*Margantsevye Antidetonatory*, edited by A. N. Nesmeyanov, Nauka, Moscow, 1971, pp. 192–199 month unknown.

Zubarev et al., *Rybn. Khoz.* (*Moscow*), vol. 9, pp. 52–54 (1977) month unknown.

*Primary Examiner*—Margaret Medley
*Attorney, Agent, or Firm*—Dennis H. Rainear; Thomas Hamilton

[57] ABSTRACT

A burner is operated by continuously feeding into its combustion zone while combustion is occurring therein, (a) a middle distillate burner fuel with which has been blended in any sequence or combination a minor combustion improving amount of fuel-soluble manganese polycarbonyl compound (s), and (b) a total amount of air above 100% of the stoichiometric amount required for complete combustion of all fuel being introduced into said zone but which is below 105% of such stoichiometric amount. Preferably at least alkali or alkaline earth metal-containing detergent and fuel-soluble dispersant have also been blended into the fuel being used. The efficiency of operation of blue and yellow burners is thereby improved, and emissions such as carbon monoxide and nitrogen oxide can be reduced as compared to operation of the same burner on the same unadditized base fuel.

20 Claims, No Drawings

ENHANCED COMBUSTION OF HYDROCARBONACEOUS BURNER FUELS

This is a continuation of U.S. patent application Ser. No. 08/645,854, filed May 14, 1996 abandoned.

TECHNICAL FIELD

This invention relates to enhanced combustion of middle distillate fuels in conventional and advanced low $NO_x$ burners. More particularly, this invention relates to methods of improving the efficiency of combustion in burners employing such fuels whereby important reductions in emissions can be achieved.

BACKGROUND

Even with the variety of measures now being taken and efforts that have been and continue to be made, air contamination continues to be of major concern, and is a problem that continues to grow, especially in urban and industrial areas. In the case of domestic and industrial burners that operate on middle distillate fuels, despite the progress that has resulted from the development of so-called blue burners which tend to emit lower levels of nitrogen oxides (NOx) than the prior so-called yellow burners, further improvements in operational efficiency and reductions in emissions in the flue gas would be a most welcome contribution to the art. Blue burners are generally designed and in many cases calibrated to operate with excess air in the range of 5 to 15% excess air over the stoichiometric (chemically equivalent) amount of air needed to burn the fuel as it is being burned in the combustion zone(s). In other words, the air intake is regulated so that the oxygen content of the air being fed to the combustion process is in the range of 5 to 15% more than the exact minimum quantity theoretically required to burn the amount of fuel being fed to the combustion process.

It has been found heretofore that manganese polycarbonyl compounds are effective in reducing smoke and soot produced on burning fuel oil in earlier types of domestic fuel oil burners. See for example U.S. Pat. No. 3,112,789 to Percy et al. which, on the basis of studies conducted with a Timken wall-flame burner, recommends operation with fuel oils containing 0.00125 to 0.005% of manganese as oil-soluble indenyl manganese tricarbonyl, cyclopentadienyl manganese tricarbonyl, and alkyl derivatives thereof using 125 to 140% of the stoichiometric amount of air. Also of interest in this connection is published European Patent Application No. EP 0 476 197A (published in March, 1992) which describes test results obtained using a domestic heating gas oil in two different burners. One was a modern burner whereas the other was a burner produced over fifteen years earlier. Both burners were adjusted to manufacturer's specifications and operated on the clear base fuel and on the same fuel to which had been added an additive formed from methylcyclopentadienyl manganese tricarbonyl along with other components such as overbased calcium sulfonate, ashless dispersant, corrosion inhibitor, metal passivator and demulsifier. Other documents of general background interest cited and abstracted in EP 0 476 197A are: Keszthelyi et al., *Period. Polytech., Chem. Eng.*, Volume 21(1), pages 79–93 (1977); *Margantsevye Antidetonatory*, edited by A. N. Nesmeyanov, Nauka, Moscow, 1971, pages 192–199; Zubarev et al., *Rybn. Khoz.* (*Moscow*), Volume 9, pages 52–4 (1977); Canadian Patent No. 1,188,891; EP Patent No. 0078249 B1; GB Patent No. 1,413,323, and to a lesser extent, U.S. Pat. No. 4,505,718.

SUMMARY OF THE INVENTION

It has now been found possible to improve the efficiency of operation of burners that operate on, i.e., employ, hydrocarbonaceous middle distillate fuels, and at the same time to reduce at least the amount of carbon monoxide emitted by the burner. This is accomplished by continuously and concurrently introducing into the combustion zone of the burner while combustion is occurring therein, (a) a hydrocarbonaceous middle distillate fuel with which has been blended a minor combustion improving amount of at least one fuel-soluble manganese polycarbonyl compound; and (b) an amount of air that is above the stoichiometric amount of air required for complete combustion of the fuel being introduced into said zone but which is less than 5% above said stoichiometric amount. By operating in this manner using this combination of features, the operational efficiency of the burner is improved and in addition, the amount of at least carbon monoxide emissions is reduced, all as compared to operation of the same burner with the same base fuel devoid of additive content and with between 5 and 15% excess air over the stoichiometric amount required to burn the fuel as it is being fed thereto.

In preferred embodiments, there are continuously fed into the combustion zone of the burner "the zone") while combustion is occurring therein, (a) hydrocarbonaceous middle distillate fuel with which has been blended in any sequence or combination at least the following ingredients: a minor combustion improving amount of (i) at least one fuel-soluble manganese polycarbonyl compound, (ii) at least one fuel-soluble alkali or alkaline earth metal-containing detergent, and (iii) at least one fuel-soluble dispersant; and (b) an amount of air that is sufficient to support combustion the fuel blend of (a) being fed into the zone; with the proviso that (c) the proportions of the fuel blend of (a) and the air of (b) being fed into the zone are maintained such that the air-to-fuel ratio is continuously above the stoichiometric amount required for complete combustion of the fuel being fed into the zone, but below 5 percent above the stoichiometric amount of air required for complete combustion of the fuel being fed into the zone.

DESCRIPTION OF PREFERRED EMBODIMENTS

The method of the invention serves to improve the combustion characteristics and reduce emissions in conventional (yellow) and advanced low $NO_x$ (blue) burners such as are used in home heating, utilities, boilers and incinerators. The invention is particularly well-suited for the operation of blue burner furnaces which involve use of staged combustion, i.e., partial combustion with air in a first stage followed by completion of the combustion with additional air in another stage. Thus use of staged burners is preferred, but not required.

In the practice of this invention, the amount of air used relative to the amount of fuel being burned is based on total quantities of fuel and of air being fed to the combustion zone, whether the combustion all takes place in one location within the burner or occurs concurrently in more than one location within the burner. Thus the term "zone" is used in an inclusive sense to include all locations in a given burner in which combustion is occurring even though portions of the total air or fuel, or both, fed thereto may be fed upstream and downstream to effect staged combustion of the overall feed of fresh fuel, and even though recycle of exhaust is employed. In any case, the total amount of air fed to the burner to support the combustion occurring therein is greater than 100% and less than 105% of the stoichiometric amount of air. It will be understood, of course, that reference to excess "air" is equivalent to excess "oxygen" as it is the free oxygen content of the air that supports the combustion process in the burner. In fact in many commercial blue burners the amount of inlet air is controlled in response to measurement of oxygen present in the flue gas. Thus for the purposes of this invention any suitable method of determining the amount of air and/or oxygen fed into the burner can be employed.

Burners suitable for use in the practice of this invention must be designed to regulate or control, or must be provided or retrofitted with means for regulating or controlling the relative amounts of fuel and air so that the feeds of fuel and air to the overall combustion in the combustion zone provide an excess of air that is above the theoretically equivalent amount to fully burn the fuel, but below 5% above this theoretically equivalent amount. The technology for designing and manufacturing new burners, and for retrofitting existing burners, with means for setting, controlling or maintaining relative proportions of fuel and air are known to those skilled in the art, and thus upon receipt of the teachings of this invention such persons will be able to provide burners or burner auxiliaries meeting the foregoing requirements.

Illustrative of the principles involved in the design, construction and operation of burners, especially of the blue burner type, are illustrated by such patents as, for example, U.S. Pat. Nos. 3,791,796; 3,808,802; 5,209,187; 5,236,327; 5,370,526; 5,460,513; and 5,462,430; and such publications as, for example, "Development and Demonstration of Low-$NO_x$ StAR [sic] Burner for High Temperature Industrial Furnaces" by Charles Bensen et al., presented at the 1994 AFRC/JFRC Symposium; "New, Low $NO_x$ Burner Design for High Temperature Process Furnaces" by R. T. Waibel et al., Copyright 1994 John Zink Company, a division of Koch Engineering Company, Inc.; "The Effect of Various Operating Parameters on $NO_x$ Formation for Internal Recirculation Burners" by Richard R. Martin, Ph.D., American Flame Research Committee International Flame Research Foundation 1993 Fall International Symposium Oct. 18–20, 1993 Tulsa, Okla.; "Enhanced $NO_x$-Reduction in Staged Combustion: Technical Application of Premix Technology in Boilers" by J. Haumann et al., ABB Corporate Research Center, Baden, Switzerland; "Ultra-Low $NO_x$ Wall-Mounted Burners" by Chad F. Gottschlich et al., Selas Corporation of America, Oct. 19, 1993.

The hydrocarbonaceous fuels utilized in the practice of this invention are comprised in general of mixtures of hydrocarbons which fall within the distillation range of about 160 to about 370° C. Such fuels are frequently referred to as "middle distillate fuels" since they comprise the fractions which distill after gasoline. The term "hydrocarbonaceous" means a middle distillate fuel composed principally or entirely of fuels derived from petroleum by any of the usual processing operations. The finished fuels may contain, in addition, minor amounts of suitable non-hydrocarbonaceous fuels or blending components and/or minor amounts of auxiliary liquid fuels of appropriate boiling points or ranges (i.e., between about 160° and about 370° C.) derived from tar sands, shale oil or coal. In principle, the advantages of this invention may be achieved in any liquid hydrocarbonaceous fuel derived from petroleum, coal, shale and/or tar sands. In most instances, at least under present circumstances, the base fuels will be derived primarily, if not exclusively, from petroleum. In many cases, specifications exist for various hydrocarbonaceous fuels or grades thereof, and the nature and character of such fuels are well-known and reported in the literature.

It is essential that a combustion-improving amount of a fuel-soluble compound having at least one carbonyl group bonded to a manganese atom has been blended with the base hydrocarbonaceous burner fuel. The resultant fuel composition containing the manganese compound in whatever form it exists after blending with the base fuel is suitable for use in the practice of this invention. Cyclopentadienyl manganese tricarbonyl compounds of the type described in U. S. Pat. No. 2,818,417 are preferred. Particularly preferred for use in the practice of this invention is methylcyclopentadienyl manganese tricarbonyl. However use can be made of manganese pentacarbonyl (dimanganese decacarbonyl) and other manganese carbonyl compounds referred to, for example, in granted European patents EP 0 476 196 B1 and EP 0 476 197 B1.

In general, the fuels used in the practice of this invention will usually contain at least about 0.5 milligram of manganese per gallon (U.S.), and preferably contain in the range of about 0.8 to about 16 milligrams of manganese per gallon (U.S.) of fuel. Most preferably, such fuels will contain in the range of about of 4 to about 6 milligrams of manganese per U.S. gallon of fuel. However, departures from the foregoing ranges may be made based on these teachings whenever such departures are deemed necessary or desirable under the particular circumstances involved, and such departures are thus within the purview of this invention. Before being blended with the fuel or with an additive mixture (e.g., additive concentrate or "package") which in turn is blended with the fuel, the manganese compound is in the form of at least one manganese compound containing at least one carbonyl group bonded or coordinated with the manganese.

Auxiliary additives are preferably also blended with the fuel prior to use. These include alkali or alkaline earth metal detergents (preferably overbased detergents, e.g., one or more overbased calcium-containing detergents); oil-soluble dispersants (e.g., one or more fuel-soluble succinimide and/or Mannich base and/or long chain polyamine dispersants); oil-soluble corrosion inhibitors; oil-soluble metal passivators or metal deactivators; oil-soluble demulsifiers; oil-soluble antioxidants; cold flow improvers; reodorants; and other suitable additives. European patents EP 0 476 196 B1 and EP 0 476 197 B1 provide comprehensive descriptions of a great many of such additives including the manganese carbonyl compounds and the proportions in which the various additives may be used to achieve excellent performance, including proportions constituting excellent combustion-improving amounts of the manganese-containing additive compounds and additive formulations formed from such additives. Thus these two European patents and the references cited therein should be consulted in the event further details are desired. Indeed, preferred fuel additives for incorporation into the fuel used in the practice of the invention are described in these two granted European patents EP 0 476 196 B1 and EP 0 476 197 B1. In any case, the additives and amounts used should be selected so as not to adversely affect in any material way and to any significant extent the performance of the fuel in the practice of this invention.

EXAMPLES

In order to illustrate the practice and advantages of this invention reference will now be made to a series of carefully controlled experiments at an independent research facility. In these studies a highly automated combustion tunnel and burner system capable of simulating both the yellow and blue burners was used. The system was fully instrumented for radial and axial sampling of combustion products and temperatures in the combustion and flue-gas tunnel.

The study involved determining, inter alia, the quantities of carbon monoxide and nitrogen oxide in the flue gas emissions as a function of the amount of excess air fed while operating a burner apparatus on a hydrocarbonaceous middle distillate fuel with which was blended a minor combustion improving amount of an additive concentrate formed from a fuel-soluble manganese polycarbonyl compound, namely methylcyclopentadienyl manganese tricarbonyl. For comparative purposes, the same type of measurements were made using portions of the same hydrocarbonaceous middle distillate fuel which did not contain any additive content.

The test apparatus was comprised of a combustion tunnel having a cross-section of 1.3 meters (4.265 feet) containing the burner apparatus at one end. The length of the tunnel extended 22 feet, the first four being occupied by the burner apparatus. Sampling gates were disposed along the remaining 18 feet of the tunnel, and one of the sampling gates was located at the tunnel exit 18 feet away from the burner. The visible flame extended to about 6 feet beyond the burner, and thus the remaining 12 feet of the tunnel constituted the flue-gas region of the apparatus.

The tunnel was not completely air-tight and therefore a back-pressure valve was located at the exit to maintain a chamber pressure of just over one atmosphere. Fuel and air mass flow controllers were calibrated daily. Both the fuel and air metering devices had manufacturer specified precisions of 1% of full scale. Fuel flow rate was 2.15 lb/hr, and air 900 $Nm^3$/hr for a stoichiometric mix. Combustion was conducted with dialed in known proportions of excess air of up to 15%.

The materials used in these experiments were an additive-free commercially-available #2 home heating oil and HiTEC®4077 additive (a commercial product of Ethyl Petroleum Additives, Inc.) formed from methylcyclopentadienyl manganese tricarbonyl and other components in accordance with the teachings of European patents EP 0 476 196 B1 and EP 0 476 197 B1. To form the fuel containing the HiTEC®4077 additive in whatever form it exists after being blended with the fuel "additized fuel"), the HiTEC®4077 additive was blended with the fuel in an amount of 750 parts by volume per million parts by volume of the fuel. Thus on a weight basis the manganese content of the additized fuel was about 2 ppm (wt/wt) or about 0.006 grams of manganese per gallon of fuel. The unadditized fuel of course had no additive content.

For carbon monoxide and nitrogen oxide determinations in burner operations pursuant to this invention under blue burner conditions, combustion was conducted at 7 different levels of excess air in the range of between 100% and 105% of the stoichiometric amount relative to the fuel being fed to the burner. As controls, four tests were conducted at different levels of excess air in this same region of excess air using the unadditized fuel. In each case the amount of carbon monoxide (CO) and the amount of nitrogen oxides (NOx) in the exit flue gas were determined from samples taken at the centerline of the exit. The test conditions and results as regards carbon monoxide emissions are summarized in Table 1. Table 2 summarizes the test conditions and results for nitrogen oxide emissions.

TABLE 1

Carbon Monoxide Reduction Per the Invention

| Test No. | Type of Fuel | Excess Air, % Over Stoichiometric | Level (ppm) of CO in Flue Gas |
|---|---|---|---|
| 1 | Additized | 4.52 | 12.8 |
| 2 | Additized | 3.22 | 12.8 |
| 3 | Additized | 2.56 | 13.6 |
| 4 | Additized | 1.80 | 13.6 |
| 5 | Additized | 0.95 | 37.3 |
| 6 | Additized | 0.70 | 58 |
| 7 | Additized | 0.31 | 262 |
| | | Average: | 58.6 |
| 8 | Un-additized | 2.71 | 24 |
| 9 | Un-additized | 1.51 | 61 |
| 10 | Un-additized | 0.67 | 325 |
| 11 | Un-additized | 0.5 | 738 |
| | | Average: | 287 |

TABLE 2

Nitrogen Oxide Reduction Per the Invention

| Test No. | Type of Fuel | Excess Air, % Over Sroichiometric | Level (ppm) of NOx in Flue Gas |
|---|---|---|---|
| 1 | Additized | 4.52 | 70.3 |
| 2 | Additized | 3.22 | 73.9 |
| 3 | Additized | 2.56 | 71.1 |
| 4 | Additized | 1.80 | 72.2 |
| 5 | Additized | 0.95 | 73.6 |
| 6 | Additized | 0.70 | 74.2 |
| 7 | Additized | 0.31 | 75.3 |
| | | Average: | 72.9 |
| 8 | Unadditized | 2.71 | 80 |
| 9 | Unadditized | 1.51 | 78 |
| 10 | Unadditized | 0.67 | 76 |
| 11 | Unadditized | 0.5 | 72 |
| | | Average: | 76.5 |

Table 3 summarizes the results of another group of tests conducted as described above in which the burner was operated pursuant to this invention with the above additized fuel composition with 3.22% excess air (oxygen) over the stoichiometric amount required to burn the quantity of fuel being fed to the combustion zone, i.e., with 103.22% of the stoichiometric or exact theoretical amount relative to the amount of fuel being combusted in the burner. A plurality of samples of the flue gas were taken along the radius of the exit and the results of the analyses of these individual samples were averaged to reflect the overall average composition of the flue gas leaving the burner. The analyses involved determinations for carbon monoxide, nitrogen oxides, carbon dioxide and sulfur dioxide. As controls, the same procedure was repeated except that the above unadditized fuel was used, and 3.08% excess air (oxygen) over the stoichiometric amount required to burn the quantity of fuel being fed to the combustion zone was used.

TABLE 3

Average Blue Burner Emissions With and Without Additive

| | Temp., ° C. | CO, ppm | $CO_2$, % | $SO_2$, ppm | $O_2$, % | NOx, ppm |
|---|---|---|---|---|---|---|
| Average Emissions, Additized Fuel | 660.67 | 12.17 | 13.57 | 68.6 | 3.22 | 65.87 |
| Average Emissions, Unadditized Fuel | 674 | 20.47 | 13.90 | 108.4 | 3.08 | 70.60 |
| Emissions, % Change | −2 | −40.6 | −2 | −37 | +5 | −7 |

It will be seen from Table 3 that substantial reductions in emissions, especially of carbon monoxide, sulfur dioxide and nitrogen oxides resulted from the practice of this invention.

It is to be understood that the terms "ingredient" or "component" or "substance" as used anywhere in the specification or claims hereof, whether the term is used in the singular or plural, are used in the sense that it is a substance employed in forming the composition referred to, and thus at least prior to inclusion, mixing or blending with other ingredients or components, the ingredient or component is in the chemical form specified. It matters not what chemical changes, transformations and/or reactions, if any, take place in the mixture or medium itself as such changes, transformations and/or reactions are the natural result of bringing the specified ingredients or components together under the conditions called for pursuant to this disclosure. It will also be recognized that the additive ingredients or components can be added or blended into the fuels individually per se and/or as components used in forming preformed additive combinations and/or subcombinations, such as additive concentrates or packages, which in turn are blended with the fuel. Accordingly, even though the claims hereinafter may refer to components or ingredients in the present tense "comprises", "is", etc.), the reference is to the ingredient or component as it existed at the time just before it was blended with the fuel and/or at the time just before it was used to form such additive combination and/or additive subcombination.

As used herein the term "fuel-soluble" means that the substance under discussion should be sufficiently soluble at 20° C. in the particular burner fuel in which it is blended to reach at least the minimum concentration required to enable the substance to serve its intended function. Preferably the substance will have a substantially greater solubility in the burner fuel than this. However, the substance need not dissolve in the burner fuel in all proportions. Overbased detergents are generally regarded as comprising stable dispersions or suspensions of finely divided or colloidal inorganic metal compounds such as carbonates. Thus while they may not meet the classical definition of solubility, they nonetheless can be blended into the fuels as preferred auxiliary ingredients to provide burner fuel compositions of entirely suitable stability for use in the practice of this invention.

It will be understood that the burners with which this invention is concerned are burners of the type that employ or utilize as the fuel a hydrocarbonaceous middle distillate fuel as distinguished from burners that employ other types of fuels such as natural gas, bunker fuels, etc. It will be further understood that the physical state of the hydrocarbonaceous middle distillate fuel at the instant of its combustion does not constitute a limitation on this invention, as the fuel may be in any appropriate physical state, such as for example in the form of liquid, vapor, droplets, mist, etc.

Each and every patent or other publication referred to in any portion of this specification is incorporated into this disclosure by reference for all purposes, as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A method for improving the efficiency of combustion in a burner that employs as its fuel hydrocarbonaceous middle distillate fuel and for concurrently reducing at least the quantity of carbon monoxide emissions from such burner, which method comprises continuously and concurrently introducing into the combustion zone of the burner while combustion is occurring therein:

a) hydrocarbonaceous middle distillate fuel with which has been blended in a minor combustion improving amount (i) at least one fuel-soluble manganese polycarbonyl compound; and b) an amount of air that is at least about 0.7% above the stoichiometric amount of air required for complete combustion of the fuel being introduced into said zone but which is less than 5% above said stoichiometric amount, wherein compound (i) is present in an amount sufficient to provide at least about 0.5 milligram of manganese per gallon (U.S.) of fuel.

2. A method as claimed in claim 1 wherein said burner is a staged burner.

3. A method as claimed in claim 1 wherein said at least one manganese polycarbonyl compound is at least one fuel-soluble cyclopentadienyl manganese tricarbonyl compound.

4. A method as claimed in claim 3 wherein said burner is a staged low $NO_x$ burner.

5. A method for improving the efficiency of combustion in a burner that employs as its fuel hydrocarbonaceous middle distillate fuel and for reducing at least the quantity of carbon monoxide emissions from such burner during operation of said burner, which method comprises:

a) continuously feeding into the combustion zone of the burner when combustion is occurring therein, hydrocarbonaceous middle distillate fuel with which has been blended concurrently and/or in any sequence and/or in any preformed combination and/or preformed subcombination thereof, at least the following ingredients: a minor combustion improving amount of (i) at least one fuel-soluble manganese polycarbonyl compound, (ii) at least one overbased alkali or alkaline earth metal-containing detergent, and (iii) at least one fuel-soluble dispersant;

b) continuously feeding into the combustion zone of the burner when combustion is occurring therein, an amount of air that is sufficient to support combustion of the fuel being fed into said zone; and c) maintaining the proportions of the fuel blend of a) and the air of b) being fed into said combustion zone such that the air-to-fuel ratio is continuously at least about 0.7 percent above the stoichiometric amount required for complete combustion of said fuel being fed into said zone, but below 5 percent above the stoichiometric amount of air required for complete combustion of said fuel being fed into said zone, wherein compound (i) is present in an amount sufficient to provide at least about 0.5 milligram of manganese per gallon (U.S.) of fuel.

6. A method as claimed in claim 5 wherein said burner is a staged burner.

7. A method as claimed in claim 5 wherein said at least one manganese polycarbonyl compound comprises at least one fuel-soluble cyclopentadienyl manganese tricarbonyl compound, wherein said at least one alkali or alkaline earth metal-containing detergent comprises at least one overbased alkali or alkaline earth metal-containing detergent, and wherein said at least one fuel-soluble dispersant comprises at least one fuel-soluble basic nitrogen-containing ashless dispersant.

8. A method as claimed in claim 7 wherein said burner is a staged low $NO_x$ burner.

9. A method as claimed in claim 7 wherein said at least one overbased alkali or alkaline earth metal-containing detergent comprises at least one overbased calcium sulphonate, phenate or sulfurized phenate detergent.

10. A method as claimed in claim 7 wherein at least the following additional ingredients have been blended concurrently, and/or in any sequence and/or in any preformed combination and/or preformed subcombination thereof, with said hydrocarbonaceous middle distillate fuel: (iv) a demulsifying amount of at least one fuel-soluble demulsifying agent; (v) a corrosion-inhibiting amount of at least one fuel-soluble aliphatic or cycloaliphatic amine; and (vi) a metal passivating amount of at least one fuel-soluble metal deactivator.

11. A method as claimed in claim 10 wherein said burner is a staged low $NO_x$ burner.

12. A method as claimed in claim 11 wherein said at least one overbased alkali or alkaline earth metal-containing detergent comprises at least one overbased calcium sulphonate, phenate or sulfurized phenate detergent.

13. A method for minimizing the quantity of carbon monoxide emitted during combustion in a burner that employs as its fuel a hydrocarbonaceous middle distillate fuel, which method comprises continuously and concurrently introducing into the combustion zone of the burner while combustion is occurring therein:

a) hydrocarbonaceous middle distillate fuel in which has been blended a minor combustion improving amount of (i) at least one fuel-soluble manganese polycarbonyl compound; and wherein the amount of air being introduced into said zone is in the range of about 100.70% and about 104.52% of said stoichiometric amount of air required for complete combustion of the fuel being introduced into said zone, wherein compound (i) is present in an amount sufficient to provide at least about 0.5 milligram of manganese per gallon (U.S.) of fuel.

14. A method as claimed in claim 13 wherein said burner is a staged burner.

15. A method as claimed in claim 13 wherein said fuel is a #2 fuel oil.

16. A method as claimed in claim 13 wherein said at least one manganese polycarbonyl compound is at least one fuel-soluble cyclopentadienyl manganese tricarbonyl compound.

17. A method as claimed in claim 13 wherein in addition to said at least one fuel-soluble manganese polycarbonyl compound, at least a minor combustion improving amount of (a) at least one alkali or alkaline earth metal-containing detergent, and (b) at least one fuel-soluble dispersant were blended with said fuel either:

i) concurrently with said at least one fuel-soluble manganese polycarbonyl compound; or ii) individually in any sequence relative to each other and relative to said at least one fuel-soluble manganese polycarbonyl compound; or iii) as a preformed subcombination apart from said at least one fuel-soluble manganese polycarbonyl compound; or iv) as a preformed additive concentrate formed by blending together individually or in any subcombination said at least one fuel-soluble manganese polycarbonyl compound, said at least one alkali or alkaline earth metal-containing detergent, and said at least one fuel-soluble dispersant; or v) in any other way by which at least the foregoing components can be blended with said fuel.

18. A method as claimed in claim 17 wherein said at least one manganese polycarbonyl compound consists essentially of methylcyclopentadienyl manganese tricarbonyl and wherein said at least one alkali or alkaline earth metal-containing detergent consists essentially of at least one overbased alkali or alkaline earth metal-containing detergent.

19. A method as claimed in claim 17 wherein said burner is a staged low $NO_x$ burner.

20. A method as claimed in claim 19 wherein said fuel is a #2 fuel oil; wherein said at least one manganese polycarbonyl compound consists essentially of methylcyclopentadienyl manganese tricarbonyl; wherein said at least one alkali or alkaline earth metal-containing detergent consists essentially of at least one overbased calcium-containing detergent; and wherein said at least one fuel-soluble dispersant consists essentially of at least one fuel-soluble succinimide dispersant or at least one fuel-soluble Mannich base dispersant or at least one fuel-soluble long chain aliphatic polyamine dispersant, or a combination thereof.

* * * * *